US005957224A

United States Patent [19]

Ilomäki

[11] Patent Number: 5,957,224

[45] Date of Patent: Sep. 28, 1999

[54] DOUBLE BIT ASSEMBLY AND METHOD OF USING THE SAME

[76] Inventor: Valto Ilomäki, Loilantie 8, Fin-33470, Ylöjärvi, Finland

[21] Appl. No.: 08/849,769

[22] PCT Filed: Dec. 13, 1995

[86] PCT No.: PCT/FI95/00678

§ 371 Date: Aug. 12, 1997

§ 102(e) Date: Aug. 12, 1997

[87] PCT Pub. No.: WO96/18798

PCT Pub. Date: Jun. 20, 1996

[30] Foreign Application Priority Data

Dec. 13, 1994 [FI] Finland ..... 945852

[51] Int. Cl.[6] ..... E21B 7/00; E21B 10/64

[52] U.S. Cl. ..... 175/57; 175/259; 175/266

[58] Field of Search ..... 175/22, 23, 171, 175/53, 57, 259, 267, 266

[56] References Cited

U.S. PATENT DOCUMENTS

| | | | |
|---|---|---|---|
| 3,190,378 | 6/1965 | Davey, Sr. et al. . | |
| 3,375,884 | 4/1968 | Bodine, Jr. | 175/22 |
| 3,835,943 | 9/1974 | Bray . | |
| 4,759,413 | 7/1988 | Bailey et al. | 175/171 X |
| 4,842,081 | 6/1989 | Parant | 175/23 |
| 5,417,290 | 5/1995 | Barrow | 175/22 X |
| 5,472,057 | 12/1995 | Winfree | 175/57 |
| 5,791,419 | 8/1998 | Välisalo | 175/53 |

OTHER PUBLICATIONS

"New method of soil and overburden drilling", Mining Magazine, vol. 168, No. 10, Oct. 1993, pp. 218–219.

*Primary Examiner*—Frank Tsay
*Attorney, Agent, or Firm*—Larson & Taylor

[57] ABSTRACT

A method to drill a hole in the soil by a bit assembly and a bit assembly comprising a ring-shaped bit (2) to drill the outer circle of the hole and to which a protection tube system (4), mounted in the hole while drilling, is coupled, and a cylindric inner bit (1) to drill the center portion of the hole, from which bit at least the rotative motion is transmitted to the outer bit (2). Drilling by the outer bit (2) and pulling out the protection tube (4) are disconnected upon need by reverse rotation of the inner bit, whereafter drilling is continued with the inner bit (1) only.

11 Claims, 1 Drawing Sheet

DOUBLE BIT ASSEMBLY AND METHOD OF USING THE SAME

FIELD OF THE INVENTION

This invention relates to a method for drilling a hole in the soil and to a bit assembly and a drill bit for use in drilling a hole or tunnel in the soil.

BACKGROUND OF THE INVENTION

Previously known are, for instance from patent specifications FI 933074 and GB 2 255 365, double bit assemblies where the inner bit that drills the center hole can be pulled out from the hole, while the ring bit that drills the outer hole circle is left in the bore. However, in these examples the inner bit can be pulled out from the hole after drilling and also reinstalled if drilling is continued.

On drilling a hole in the soil, the most general case is that the first portion of the hole is made in soft soil, whereby a protection tube is pulled into the drilled hole. Eventually, on hitting rock, the protection tube is not needed anymore. Drilling can then be continued without a protection tube if change of the drilling procedure is easy. A problem arises when the drilling procedure is changed. The inner bit must be pulled out from the hole and replaced by a bit that drills a hole with a smaller diameter. During this replacement, the complete drilling equipment is pulled out from the hole and reinstalled furnished with a new rock-drilling bit. This takes time and money, especially if the first bore in the soil is long.

SUMMARY OF THE INVENTION

By means of a method and bit assembly with a proper bit according to this invention, a surprising improvement is achieved.

The advantage of this invention is that a hole requiring a protection tube is drilled with the same bit assembly as a hole into rock. When the protection tube is not needed, drilling proceeds nonstop with the inner bit only. In case drilling is stopped in a dead end, the inner bit can be pulled out through the outer bit. Even the outer bit can be pulled out from the bore on condition that also the protection tube is also pulled out simultaneously.

The bit assembly and the method can be applied to drilling by hammering but also to bits rotating only. The groove in the bayonet joint that opens in both of the axial directions is favorably arranged as a flow channel for flushing medium, whereas the joint is a simple construction.

BRIEF DESCRIPTION OF THE DRAWINGS

In the following the invention is disclosed with reference to the enclosed drawing, where.

DETAILED DESCRIPTION OF THE PREFERRED EMBODIMENTS

Figure 1:
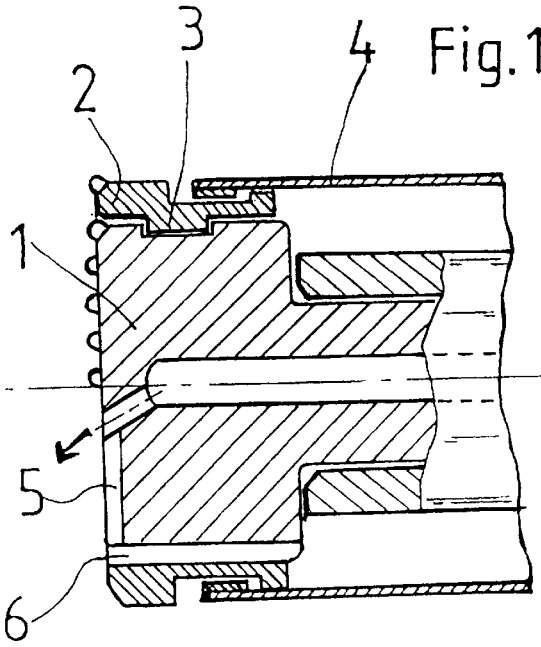
FIG. 1 shows a section of the bit assembly along line A—A.

FIG. 1 illustrates a section of the bit assembly including a cylindric inner bit 1 fastened to the head of hammer 7, a ring-shaped outer bit 2 around the inner bit 1 and a protection tube 4 mounted in the hole while drilling and reaching the outer shell of outer bit 2. The inner bit 1 and outer bit 2 are interconnected by a bayonet joint, where rotation is transmitted to the outer bit 2 by the inner bit 1. The inner bit 1 also transmits the hammer impacts to outer bit 2. Outer bit 2 pulls protection tube 4 into the hole by means of the joint lap between them, which has restriction for the mutual axial motion.

Figure 2:
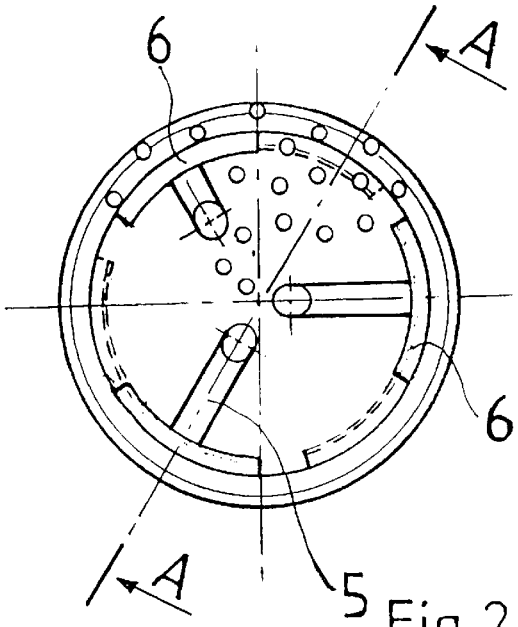
FIG. 2 shows the bit assembly viewed from the front.
Figure 3:
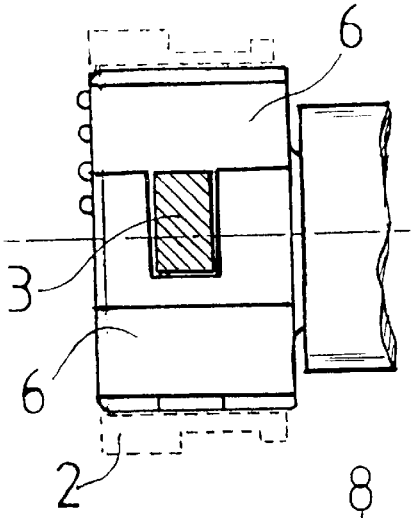
FIG. 3 shows the inner bit surface viewed from one side.

FIG. 2 shows that in the circle between bits 1 and 2 three bayonet joints are placed. In the inner bit 1 three axial grooves 6 are formed to run through the bit. Correspondingly, there are in outer bit 2 three projecting parts 3 with the same spacing which move in grooves 6. Sidewards from grooves 6 in inner bit 1 surface, as per FIG. 3, there are notches for projecting parts 3, into which the projecting parts 3 are guided due to the mutual rotation of the bits 1 and 2. Thereby, bits 1 and 2 are in a locked state and bit 2 is rotated by bit 1, while the locking is retained. The locking is opened by reverse rotation. Projecting parts 3 are square in order to receive the impacts from a larger surface area of the inner bit 1 and to transmit them to the outer bit 2. Groove 6 of inner bit 1 is also a flow channel for the flushing medium, whose direction of flow, in this case, is backward in the channel.

Figure 4:
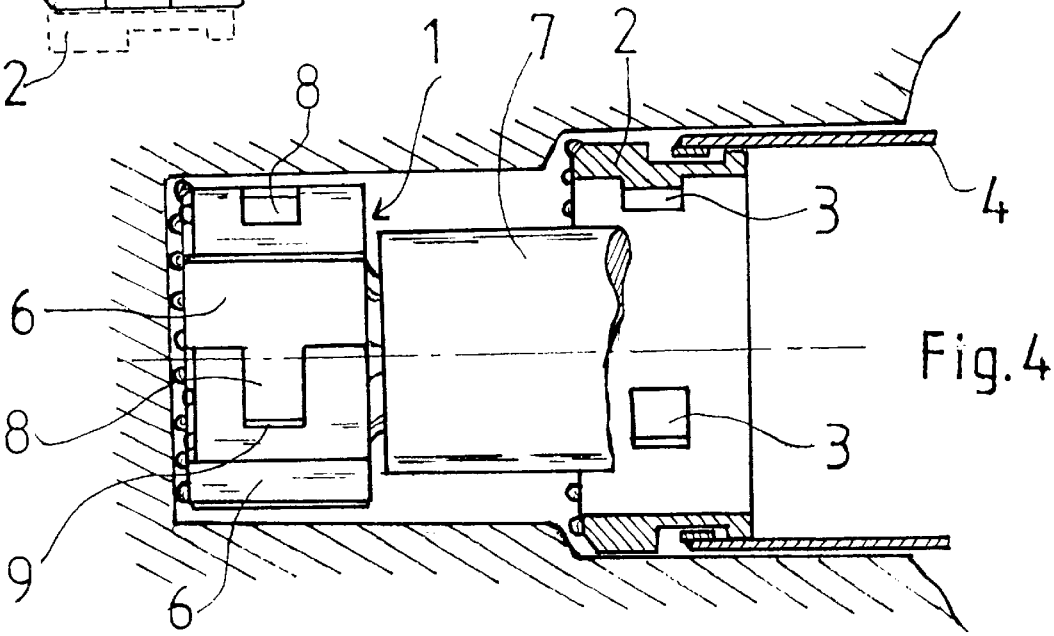
FIG. 4 shows a section of bore, where drilling proceeds by the inner bit only.

In FIG. 4 drilling has advanced to a location, where ring bit 2 and protection tube 4 have been left. Drilling has proceeded only by bit 1. For demounting of the inner bit 1 from the outer bit 2, the rotation of the drill assembly has been reversed. Hammer 7 transmits the rotation to inner bit 1. Reverse rotation of inner bit 1 opens the bayonet joint in such a way that projecting part 3 turns in groove 8 and enters groove 6. Thereafter, drilling further by reverse rotation, projecting parts 3 glide out from grooves 6 to the front side of the ring bit, where the ring bit 2 stops rotating and remains totally immobile. The inner bit 1 drills rock or other hard ground that does not collapse into the hole. If drilling is stopped at a wanted depth or length, bit 1 and the drilling equipment are pulled out from the hole. Bit 1 passes ring bit 2 in running through it, when the bit 1 is turned into a position where projecting parts 3 hit grooves 6 and glide through bit 2.

Figure 5:
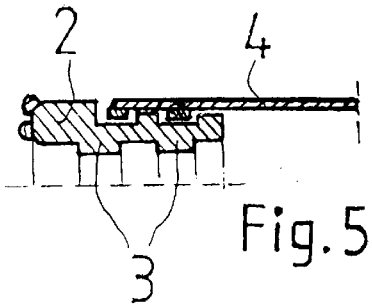
FIG. 5 shows a cross-section of the ring bit.

FIG. 5 illustrates an example of ring bit 2 with several projecting parts 3 for several sequentially arranged axial bayonet joints, by means of which construction a face to transmit impacts to ring bit 2 is produced. Likewise, the protection tube 4 is pulled with several sequential shoulder faces. On using many sequential bayonet joints and pulling shoulders of protection tube 4, it is possible to make ring bit 2 thinner and yet strong enough for drillings of longer duration.

By means of a method and a bit assembly as per this invention it is possible to carry out, advantageously, s.c. anchoring drilling, where drilling is done by the outer bit until rock is hit and a certain distance by the inner bit in the rock. Since reversed flushing is used for removal of drill waste, whereby there is through inner bit 1 a straight channel tube up to the surface, an anchor wire rope can be taken through the channel to the bottom of the bore and, for instance, on pulling up the bit, concrete can be poured through the channel into the hole. When the hole is filled and bit 1 pulled out to the level of ring bit 2, the outer bit 2 and even the protection tube 4 are then pulled out and the hole is filled with concrete at the same time. If during drilling the ring bit 2 and the protection tube 4 have been left in the hole at too early a stage, the inner bit 1 can be pulled up to the ring bit 2 and locked and drilling continued. In order to carry out properly the mutual rotation of bits 1 and 2 necessary for locking, it is worth it to record on the ground the mutual depth position of protection tube 4 and the drill rod inside it, when bits 1 and 2 are locked, so that relocking could be made in the same position. This is of great significance, especially if there are several sequential bayonet lockings between the bits as shown in FIG. 5.

The inner bit 1 according to this invention includes transverse ring grooves on its outer shell 8 ending in a vertical wall 9. The groove 8 flanks function as faces transmitting impacts to ring bit 2 and the face 9 as rotation-transmitting means. The outer shell of bit 1 lacks stepped impact-transmitting shoulders known from previous designs.

By means of a method and bit assembly according to this invention both vertical as well as horizontal holes can be drilled. Likewise, the axial groove of the bayonet joint can also be in the ring bit 2 and the projecting part in the inner bit 1.

I claim:

1. An inner bit movable through either open end of a ring bit that drills an outer circumference of a hole and securable to said ring bit to form a united bit assembly for drilling a hole or tunnel in soil, said inner bit including transverse grooves on an outer cylindrical surface with respect to an axial direction, side faces of the grooves protruding in a direction of a radius of the inner bit and transmitting impacts and rotation to the ring bit.

2. An inner bit according to claim 1 further comprising axial grooves.

3. An inner bit according to claim 1 wherein the transverse grooves are sequentially arranged on the inner bit, the transverse grooves being open at one end and closed at an opposite end by an end face protruding in a direction of a radius of the inner bit.

4. A method for drilling a hole in soil by means for a bit assembly comprising a ring-shaped outer drill bit for drilling an outer circumference of the hole, said outer bit being arranged to pull a protection tube system into the hole when the drilling advances, a cylindrical inner bit for drilling a center portion of the hole and a locking system comprising grooves and projecting parts, the projecting parts being located on one of a cylindrical inner surface of the outer bit and a cylindrical outer surface of the inner bit and the grooves being located in the other of the cylindrical inner surface of the outer bit and the cylindrical outer surface of the inner bit, said projections being movable into said grooves for locking said inner and outer bits and movable out of said grooves to allow transverse movement between said inner and outer bits, rotative motion of said bit assembly being transmitted from said inner bit to said outer bit by means of said locking system, said method comprising the steps of:

locking said inner and outer bits;

drilling by means of the outer bit and pulling of the protection tube;

disconnecting the outer bit from the inner bit at a desired drilling depth; and continuing drilling with said inner bit only.

5. A method according to claim 4, wherein, during said step of drilling by means of said outer bit, the inner bit transmits impacts to the outer bit by means of said projecting parts.

6. A method according to claim 4, wherein, when said inner bit and said outer bit are unlocked during said step of disconnecting, the inner bit is movable through the outer bit in forward and backward transverse directions and, upon need, the outer bit is lockable to the inner bit.

7. A method according to claim 4, wherein a first portion of a hole is drilled during the step of drilling by the locked inner and outer bits, and a second portion of the hole is drilled by the inner bit during said step of continuing drilling, said method further comprising the step of removing the inner bit from the hole either alone or together with the outer bit and the protection tube.

8. A bit assembly including:

an inner bit for drilling a center of a hole;

an outer bit for drilling an outer circumference of said hole, the inner bit being threaded through the outer bit;

a protection tube mounted in said hole during drilling and coupled to said outer bit; and a rotation-transmitting joint between said inner and outer bits, the joint including a locking system comprising grooves and projecting parts, the projecting parts being located on one of a cylindrical inner surface of the outer bit and a cylindrical outer surface of the inner bit, and grooves being located in the other of the cylindrical inner surface of the outer bit and the cylindrical outer surface of the inner bit, the projecting parts being movable into said grooves for locking said inner and outer bits to allow drilling by said outer bit and movable out of said grooves to allow movement of said inner bit out of said outer bit to allow drilling by said inner bit only.

9. A bit assembly according to claim 8, wherein the locking system comprises one or more sequential bayonet joints between the inner bit and the outer bit for transmitting rotative motion and drilling force from the inner bit to the outer bit.

10. A bit assembly according to claim 8, wherein one of the grooves extending in an axial direction in one of the inner and outer bits comprises a flow channel for flushing medium.

11. The bit assembly according to claim 8, wherein said grooves are located in the inner bit and the projecting parts are located in the outer bit.

* * * * *